US009246220B2

(12) United States Patent
Chiang et al.

(10) Patent No.: US 9,246,220 B2
(45) Date of Patent: Jan. 26, 2016

(54) FULL-BAND ANTENNA

(71) Applicant: LUXSHARE-ICT CO., LTD., Taipei (TW)

(72) Inventors: Chien Yu Chiang, New Taipei (TW); Sheng Hsin Chang, Kaohsiung (TW)

(73) Assignee: SHENZHEN LUXSHARE ACOUSTICS TECHNOLOGY LTD., Shenzhen, Guangdong Province (CN)

( * ) Notice: Subject to any disclaimer, the term of this patent is extended or adjusted under 35 U.S.C. 154(b) by 188 days.

(21) Appl. No.: 14/159,717

(22) Filed: Jan. 21, 2014

(65) Prior Publication Data

US 2015/0207229 A1 Jul. 23, 2015

(51) Int. Cl.
*H01Q 7/00* (2006.01)
*H01Q 1/50* (2006.01)

(52) U.S. Cl.
CPC ... *H01Q 7/00* (2013.01); *H01Q 1/50* (2013.01)

(58) Field of Classification Search
CPC ..... H01Q 7/00; H01Q 1/50
USPC ..... 343/866, 867, 868, 870
See application file for complete search history.

(56) References Cited

U.S. PATENT DOCUMENTS

| | | | | |
|---|---|---|---|---|
| 6,034,651 | A * | 3/2000 | Enguent | G06K 7/10336 340/572.7 |
| 7,265,726 | B2 * | 9/2007 | Kenoun | H01Q 1/38 343/700 MS |
| 7,728,785 | B2 * | 6/2010 | Ozden | H01Q 1/243 343/866 |
| 8,471,768 | B2 * | 6/2013 | Wang | H01Q 1/243 343/700 MS |
| 2010/0085268 | A1 * | 4/2010 | Yeh | H01Q 7/00 343/803 |
| 2011/0148718 | A1 * | 6/2011 | Wang | H01Q 1/243 343/702 |

* cited by examiner

*Primary Examiner* — Huedung Mancuso
(74) *Attorney, Agent, or Firm* — Cheng-Ju Chiang

(57) ABSTRACT

A full-band antenna includes a dielectric layer, and a first and a second patterned conductive layer provided on the dielectric layer. The first patterned conductive layer includes a feed portion and a loop portion outwardly extended from the feed portion. The loop portion defines a plurality of radiation sections, between which a multi-coupling effect is created to form at least one variable frequency. The second patterned conductive layer includes a conductive portion and a short-circuit portion. The conductive portion forms at least one fixed frequency. The at least one variable frequency of the loop portion can be adjusted in its frequency distribution and frequency range by changing a width of the radiation sections and a spacing distance between the radiation sections.

11 Claims, 8 Drawing Sheets

FULL-BAND ANTENNA

FIELD OF THE INVENTION

The present invention relates to an antenna structure for radio frequency communication, and more particularly to a full-band antenna that enables different types of antennas to be miniaturized while having increased receiving bands.

BACKGROUND OF THE INVENTION

In the new era of wireless communication, various kinds of high technological communication devices have been constantly introduced into the market to create prosperous development in the business of communication products. Among others, mobile devices have the advantages of being portable and convenient for use and therefore have become the major communication devices among consumers. Further, to meet the consumers' demand for multifunction, the conventional dual-frequency mobile communication devices have also been replaced by the new multi-frequency mobile communication devices.

An antenna is a microwave device that is particularly designed for propagating electromagnetic energy in a specific direction. The antenna is mainly used to effectively radiate a signal from a transmitter into a free space or to effectively couple a remotely transmitted electric signal to a receiver. Therefore, an antenna is considered a transducer. Currently, the antennas built in common mobile devices include the following several types: monopole antenna, dipole antenna, planar inverted-F antenna (PIFA), and loop antenna.

The monopole antenna and the dipolar antenna are characterized in their considerably good transmitting and receiving power. However, they have the problem with SAR (Specific Absorption Rate) test and often fail to satisfy the electromagnetic wave energy absorption rate test.

The planar inverted-F antenna (PIFA) is advantageous for use in a product having very limited internal space and can be built in the mechanism to give the product a beautiful appearance. However, it often has relatively short transmission range when being used in some complicated space.

The loop antenna is usually used in high-frequency signal transmission. However, it has high input impedance and therefore can not be applied to small-sized communication devices.

FIG. 1 shows a prior art full-band internal antenna developed for mobile communication devices. This type of full-band internal antenna is provided on a dielectric layer 10 and includes a first radiation section 11 and a second radiation section 12. The first radiation section 11 has an end being extended to form a branch section 13 for electrically connecting to a short-circuit portion 14. The branch section 13 further includes an adjustment section 15. The second radiation section 12 is rightward extended to form an extended section 16, and is leftward extended to form a long arm portion 17, which is parallel to the first radiation section 11. To comply with the relevant telecommunication codes, the currently designed antennas generally have two types of relatively large sizes, that is, 80×13×0.4 mm and 70×13×0.4 mm. However, antennas with these two types of sizes could no longer match the nowadays multifunctional and miniaturized mobile devices.

It is therefore necessary to provide an internal antenna structure that employs a spiral design and a multi-coupling mechanism to enable miniaturized antenna size and receipt of multiple frequencies while complying with relevant telecommunication codes.

SUMMARY OF THE INVENTION

A primary object of the present invention is to provide a full-band antenna applicable to various different types of antennas, so that different types of antennas can have reduced overall size and comply with relevant telecommunication codes without the need of changing their existing structural configurations.

Another object of the present invention is to provide a full-band antenna that not only reserves the fixed frequency range of conventional antennas but also forms at least one variable frequency range different from the fixed frequency range, so as to increase the radio-frequency communication bands usable by antennas.

A further object of the present invention is to provide a full-band antenna that enables adjustment of the frequency distribution and frequency range of a variable frequency simply by changing the width of and the spacing distance between the patterned conductive traces of the antenna, so that the antenna can meet different requirements in use and have largely upgraded industrial and commercial applicability.

To achieve the above and other objects, the full-band antenna according to a first embodiment of the present invention includes a dielectric layer, a first patterned conductive layer, and a second patterned conductive layer. Both of the first and the second patterned conductive layer are provided on the dielectric layer.

The first patterned conductive layer includes a feed portion and a loop portion outwardly extended from the feed portion and having a plurality of turns of loops. The loop portion defines a plurality of radiation sections that are mutually coupled. The second patterned conductive layer includes a conductive portion and a short-circuit portion; and the conductive portion forms at least one fixed frequency for general antennas. The multi-coupling effect created between the radiation sections of the loop portion forms at least one variable frequency. The variable frequency of the loop portion can be adjusted in its frequency distribution and frequency range simply by changing a width of and a spacing distance between the radiation sections, so as to increase the radio-frequency communication bands that are usable by the antenna.

In an operable embodiment of the present invention, the conductive portion of the full-band antenna includes a first radiation section parallel to and spaced from the loop portion. The first radiation section is extended from an end to form a branch section, which is connected to the short-circuit portion and has a sidewardly protruded adjustment section for finely adjusting the at least one fixed frequency. The first radiation section further includes a sidewardly protruded section located corresponding to the loop portion, so that a coupling effect is created between the protruded section and the loop portion. The conductive portion further includes a second radiation section connected to the feed portion and including an extended section.

In an another operable embodiment of the present invention, the conductive portion of the full-band antenna includes a first radiation section, a second radiation section parallel to the first radiation section, and a branch section. Both of the first and the second radiation section have an end connected to the branch section. Another end of the second radiation section opposite to the branch section is connected to the feed portion, and another end of the branch section opposite to the first and second radiation sections is connected to the short-circuit portion.

In a further operable embodiment of the present invention, the conductive portion includes a connection section connected to the loop portion, a first radiation section connected to an end of the connection section opposite to the loop portion, and a branch section extended from another end of the first radiation section opposite to the connection section. The branch section includes a sidewardly protruded adjustment section for finely adjusting the at least one fixed frequency. The feed portion includes two electrical connection sections extended through the dielectric layer to electrically connect a front surface to a rear surface of the dielectric layer. The two electrical connection sections respectively have a first end located on the front surface of the dielectric layer and an opposite second end located on the rear surface of the dielectric layer. The first ends of the two electrical connection sections are connected to the loop portion and a signal feed line, respectively; and the second ends of the two electrical connection sections are connected to each other via a conductive trace section.

In all of the operable embodiments, the loop portion can have a square shape. However, the loops of the loop portion can be in a rectangular shape, a round shape, a triangular shape or a polygonal shape according to the requirement in design. Further, the spacing distance between the loops of the loop portion can be variable.

Unlike the conventional antennas that can not be further reduced in size due to the need of complying with the relevant telecommunication codes, the present invention is characterized by additionally including a spiral-shaped loop portion, which effectively reduces the room needed by the antenna and the manufacturing cost thereof. The loop portion also provides a multi-coupling mechanism to enable effective adjustment of the required frequencies for different frequency distribution and increased receiving frequency ranges. With this design, the full-band antenna of the present invention can be applied to a plurality of different types of antenna structures to enable antenna size miniaturization while covering all required bandwidths, so that the antenna can have increased applicability in industrial and commercial fields.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
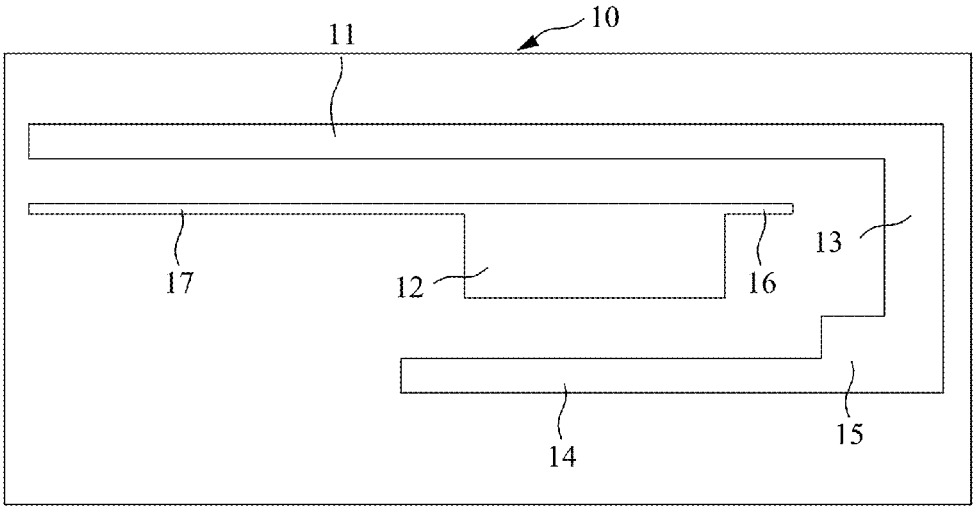
FIG. 1 (Prior Art)
FIG. 1 is a structural view of a conventional full-band antenna.

The present invention will now be described with some preferred embodiments thereof and with reference to the accompanying drawings. For the purpose of easy to understand, elements that are the same in the preferred embodiments are denoted by the same reference numerals.

Figure 2:
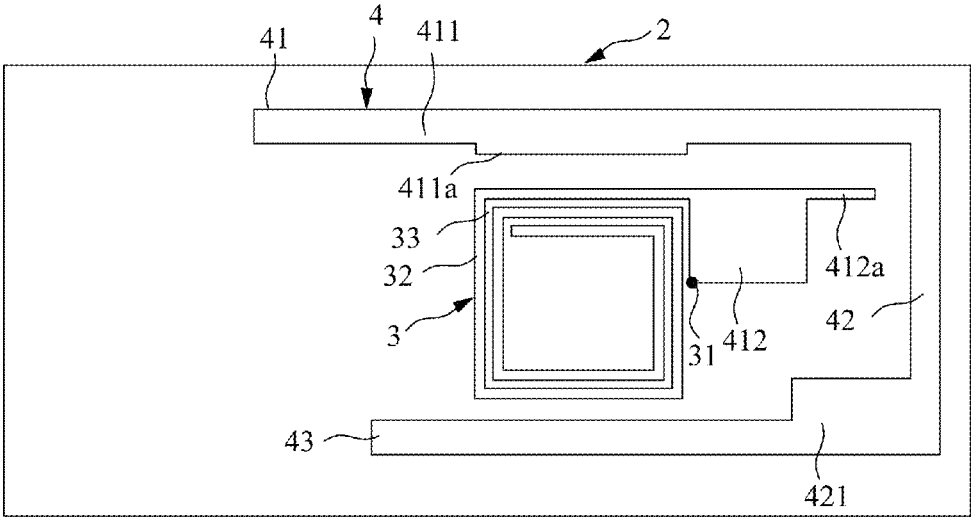
FIG. 2 is a structural view of a full-band antenna according to a first preferred embodiment of the present invention.

FIG. 1 is a structural view of a conventional full-band antenna, and FIG. 2 is a structural view of a full-band antenna according to a first preferred embodiment of the present invention. Please refer to FIGS. 1 and 2 at the same time. The full-band antenna of the present invention shown in FIG. 2 has a first radiation section 411 of 60 mm in length, which is about 14-25% shorter compared to the conventional full-band antenna of FIG. 1, which has two common sizes of 70 mm and 80 mm.

As shown in FIG. 2, the full-band antenna according to the first preferred embodiment of the present invention includes a dielectric layer 2, on a top of which a first patterned conductive layer 3 and a second patterned conductive layer 4 are provided. The antenna of the present invention is made of a conductive material and small in size, and can therefore be conveniently used in a mobile communication device.

In the illustrated first preferred embodiment, the first patterned conductive layer 3 includes a feed portion 31 connected to a signal feed line (not shown), and a loop portion 32 leftward extended from the feed portion 31. The loop portion 32 consists of a plurality of turns of loops and defines a plurality of mutually coupled radiation sections 33 between the turns of the loop portion 32. The loop portion 32 can be rectangular, round, triangular or polygonal in shape.

In brief, the loop portion 32 of the full-band antenna of the present invention has a plurality of turns of loops and defines a plurality of radiation sections 33. The loop portion 32 is in the form of a spiral. The number of turns of the loop portion 32 can be three (3), and the radiation sections 33 can have a width of 0.8 mm and be spaced from one another by a distance of 0.3 mm. The above-mentioned first radiation section 411 is parallel to the loop portion 32, and includes a sideward protruded section 411*a*, which is located corresponding to the loop portion 32 and spaced from the latter by a predetermined distance. The radiation sections 33 defined between the turns of the loop portion 32 are mutually multi-coupled, and the loop portion 32 and the protruded section 411*a* of the first radiation section 411 are also mutually coupled. Through the action of the above two mutual-coupling mechanisms, the full-band antenna of the present invention can have at least one variable frequency. Thus, by adjusting the number of turns of the loop portion 32, the spacing distance between the spaced radiation sections 33, as well as the location and shape of the loop portion 32, it is able to achieve the effect of changing the frequency. Wherein, the above-mentioned variable frequency is ranged from 1410 MHz to 1510 MHz.

The second patterned conductive layer 4 includes a conductive portion 41 for forming a fixed frequency and a short-circuit portion 43 for grounding. The conductive portion 41 includes the above-mentioned first radiation section 411 and a second radiation section 412, which are parallel to each other. The first radiation section 411 has an end perpendicularly downwardly extended to form a branch section 42. Another end of the branch section 42 opposite to the first radiation section 411 is connected to the short-circuit portion 43. The short-circuit portion 43 is connected to a ground signal line (not shown). The second radiation section 412 is connected to the feed portion 31 and includes an extended section 412*a*, which is parallel to the first radiation section 411. With the above-structured full-band antenna, the first radiation section 411 of the conductive portion 41 has a fixed lower frequency ranged from 704 to 960 MHz, and the second radiation section 412 has a fixed higher frequency ranged from 1710 to 2170 MHz.

The branch section 42 of the first radiation section 411 is provided with a sidewardly protruded adjustment section 4211, which functions to reduce the impedance of the whole antenna structure. By adjusting the shape and area the adjustment section 421, it is able to finely adjust the fixed frequencies of the conductive portion 41.

Figure 3:
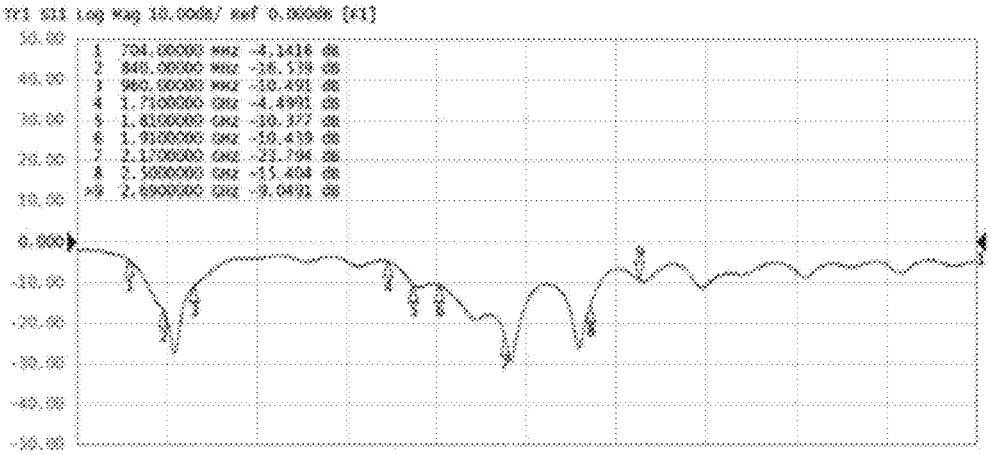
FIG. 3 (Prior Art)
FIG. 3 is a frequency response plot of the conventional full-band antenna.
Figure 4:
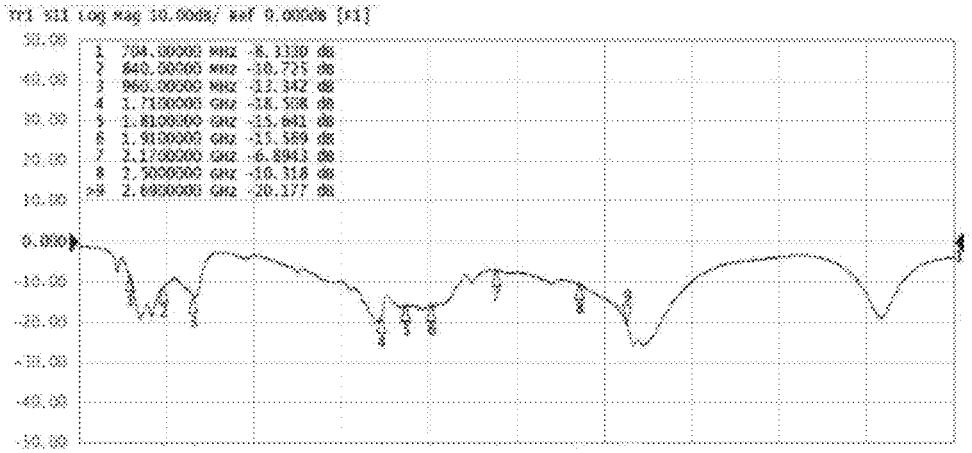
FIG. 4 is a frequency response plot of the full-band antenna of the present invention.
Figure 5:
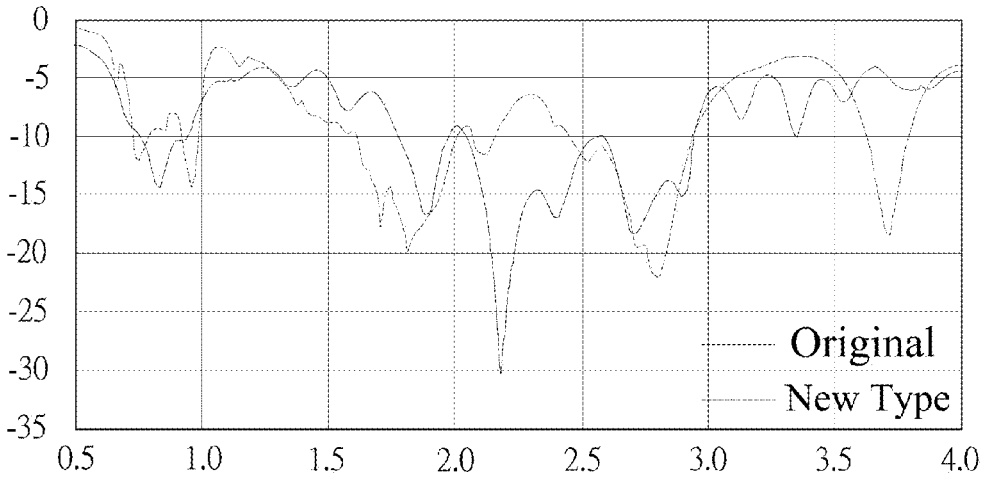
FIG. 5 compares the frequency response plots of the conventional full-band antenna and the full-band antenna of the present invention.

FIGS. 3 and 4 are frequency response plots of the conventional full-band antenna of FIG. 1 and the full-band antenna of the present invention, respectively; and FIG. 5 combines and compares the frequency response plots of FIGS. 3 and 4. Please refer to FIGS. 3, 4 and 5, in which the x-axis indicates bands and y-axis indicates dB values. As can be seen in FIG. 5, when comparing at the same frequency points on the two frequency response plots, the full-band antenna of the present invention has smaller peak values for most bandwidths, which means the full-band antenna of the present invention has lower reflection loss and accordingly very good antenna matching as compared to the conventional full-band antenna.

Figure 6:
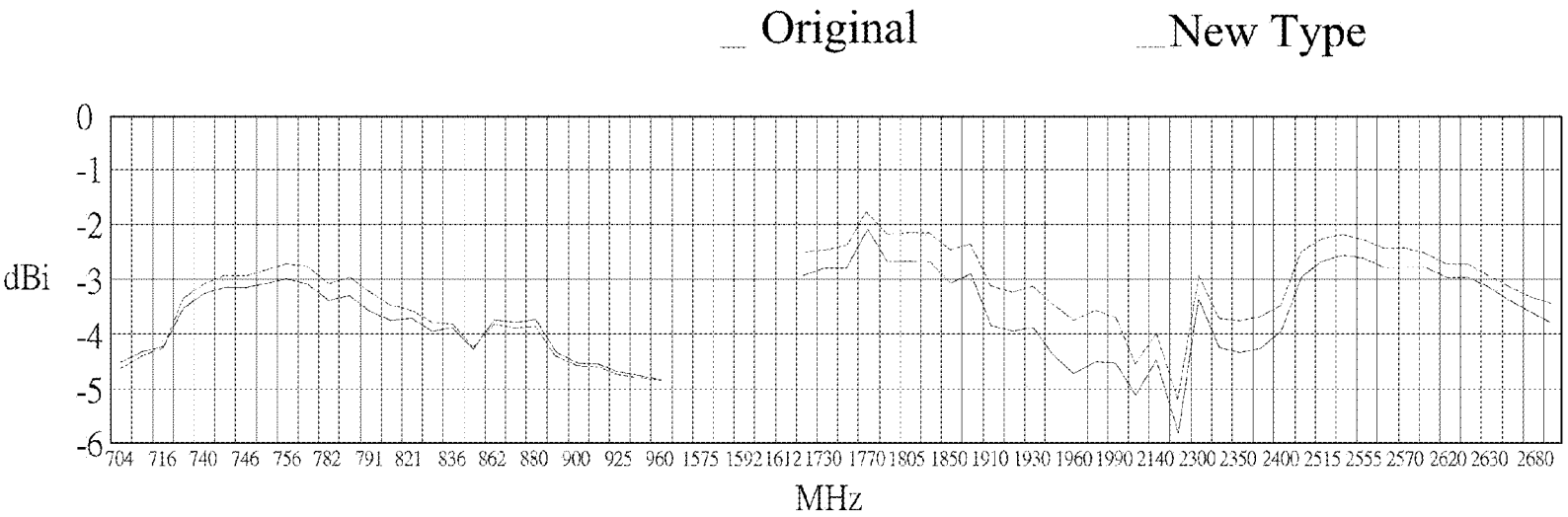
FIG. 6 compares the conventional full-band antenna and the full-band antenna of the present invention for their radiation efficiency.

Please refer to FIG. 6 that compares the conventional full-band antenna and the full-band antenna of the present invention for their radiation efficiency. In FIG. 6, x-axis indicates bands in MHz and y-axis indicates absolute antenna gains in dBi. As can be seen in FIG. 6, the full-band antenna of the present invention always show better absolute antenna gain at both lower and higher frequencies. Therefore, the full-band antenna of the present invention has better antenna radiation efficiency than the conventional full-band antenna. As can be seen from FIGS. 3, 4, 5 and 6, the full-band antenna according to the first preferred embodiment of the present invention is superior to the conventional full-band antenna in terms of reflection loss and antenna radiation efficiency. Therefore, the present invention can ensure optimized antenna performance even if it is miniaturized in size.

Figure 7:
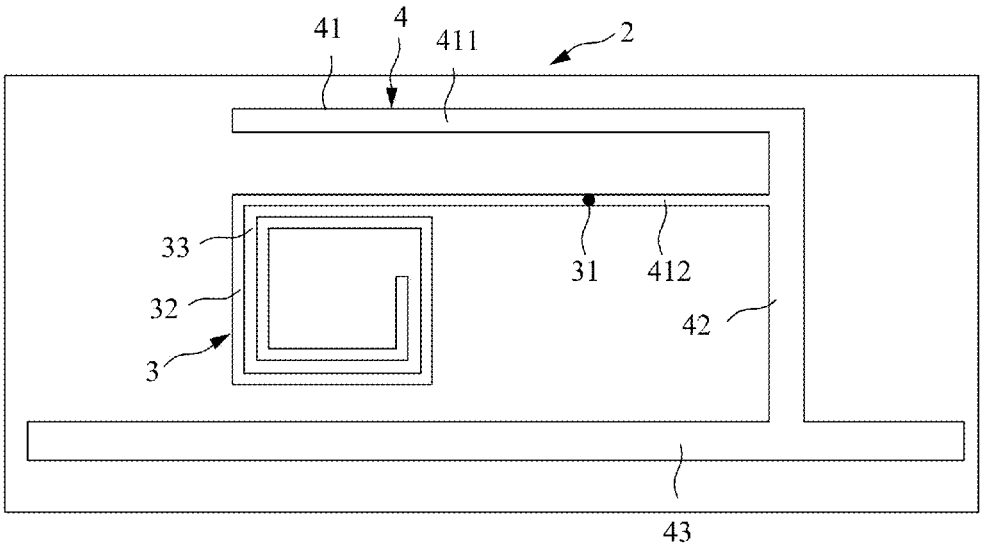
FIG. 7 is a structural view of a full-band antenna according to a second preferred embodiment of the present invention.

FIG. 7 shows that the full-band antenna according to a second preferred embodiment of the present invention is a planar inverted-F antenna (PIFA), which includes a first patterned conductive layer 3 having a spiral-shaped loop portion 32 structurally similar to that in the first preferred embodiment, and a second patterned conductive layer 4 having a conductive portion 41 and a short-circuit portion 43. In the second preferred embodiment, the conductive portion 41 is formed of a first radiation section 411 and a second radiation section 412 parallel to the first radiation section 411, and both of the first and second radiation sections 411, 412 are connected at one end to a branch section 42. The branch section 42 also connects the conductive portion 41 to the short-circuit portion 43. The second radiation section 412 is connected at another end to a feed portion 31 of the first patterned conductive layer 3. With the loop portion 32 connected to the feed portion 31, the radiation sections 33 defined on the loop portion 32 form a multi-coupling mechanism to form at least one variable frequency of about 1700 MHz.

Figure 8:
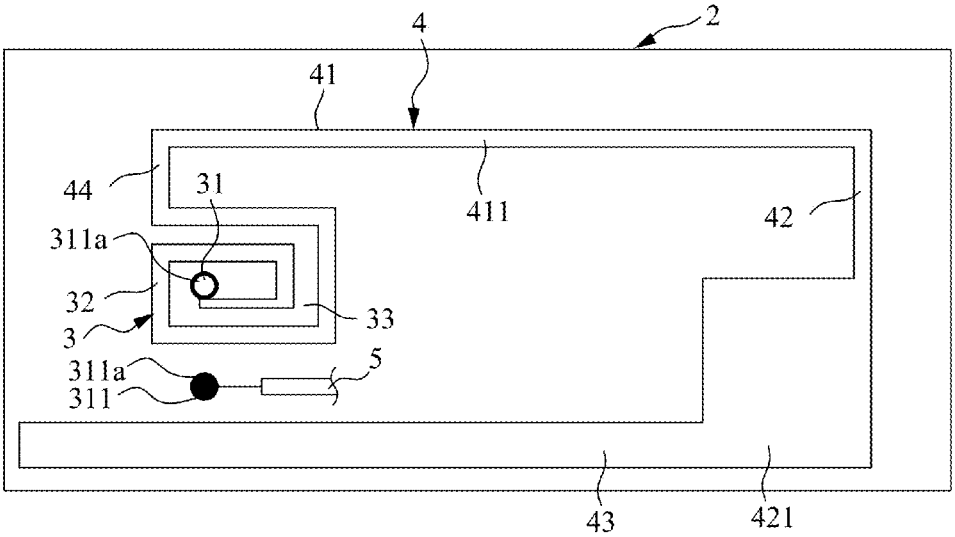
FIG. 8 is a structural view of a front side of a full-band antenna according to a third preferred embodiment of the present invention.
Figure 9:
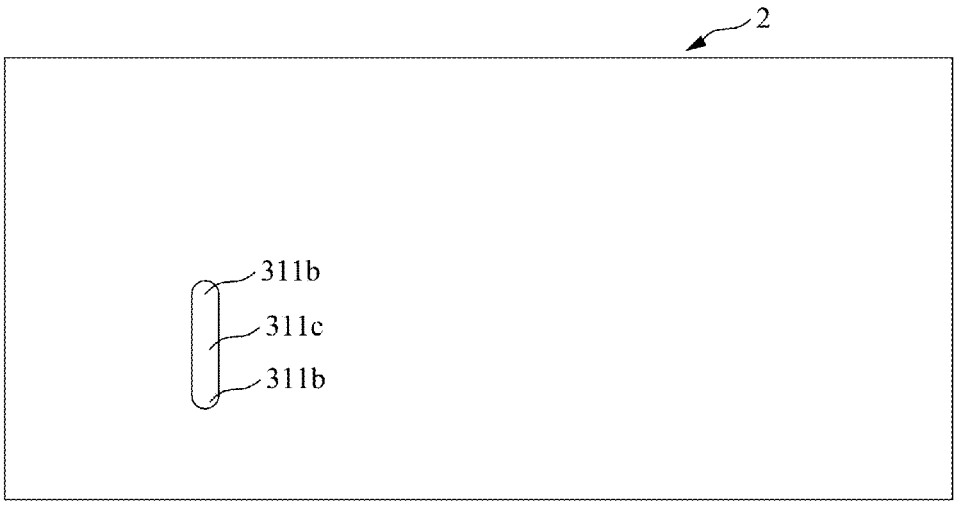
FIG. 9 is a structural view of a rear side of the full-band antenna of FIG. 8.
Figure 10:
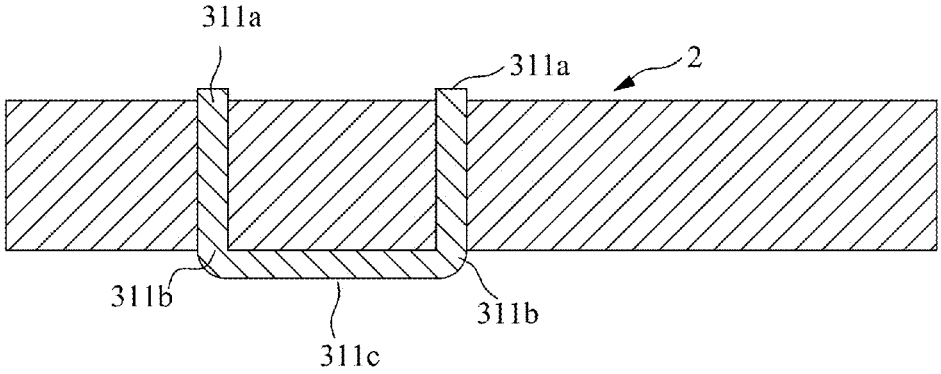
FIG. 10 is a sectional view of FIG. 8.

FIG. 8 is a structural view of a front side of a full-band antenna according to a third preferred embodiment of the present invention, FIG. 9 is a structural view of a rear side of the full-band antenna of FIG. 8, and FIG. 10 is a sectional view of FIG. 9. Please refer to FIGS. 8, 9 and 10. The full-band antenna in the third preferred embodiment is a loop antenna, which includes a first patterned conductive layer 3 similar to those in the first and second preferred embodiments, and a second patterned conductive layer 4 formed of a conductive portion 41 and a short-circuit portion 43. In the third preferred embodiment, the conductive portion 41 includes a connection section 44 having an end connected to the loop portion 32, a first radiation section 411 having an end connected to another end of the connection section 44 opposite to the loop portion 32. Another end of the first radiation section 411 opposite to the connection section 44 is extended to form a branch section 42 for connecting to the short-circuit portion 43. The branch section 42 includes a sidewardly protruded adjustment section 421 for finely adjusting the fixed frequencies of the conductive portion 41. The first patterned conductive layer 3 has a feed portion 31, which includes two electrical connection sections 311 extended through the dielectric layer 2 to electrically connect a front surface to a rear surface of the dielectric layer. The two electrical connection sections 311 respectively have a first end 311*a* located on the front surface of the dielectric layer 2 and an opposite second end 311*b* located on the rear surface of the dielectric layer 2. The first ends 311*a* of the two electrical connection sections 311 are connected to the loop portion 32 and a signal feed line 5, respectively. A signal fed via the signal feed line 5 is propagated from the corresponding first end 311*a* through the corresponding electrical connection section 311 to the second end 311*b* thereof, and is then further transmitted to a conductive trace section 311*c* on the rear surface of the dielectric layer 2. The signal is further propagated along the conductive trace section 311*c* on the rear surface of the dielectric layer 2 to the other electrical connection section 311 via the second end 311*b* thereof, and is finally transmitted to the other first end 311*a* that is connected to the loop portion 32. In the third preferred embodiment, with the loop portion 32 connected to the feed portion 31, the radiation sections 33 defined on the loop portion 32 form a multi-coupling mechanism to form at least one variable frequency ranged from about 2500 to about 2600 MHz.

All the first, second and third preferred embodiments of the present invention are characterized by additionally including a spiral-shaped loop portion 32, so that some particularly structures of the antenna are mutually coupled to form a variable bandwidth. With this design, the present invention can be applied to a plurality of different types of antenna structures to enable a size-miniaturized antenna to cover all required bandwidths.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A full-band antenna, comprising:

a dielectric layer;

a first patterned conductive layer being provided on the dielectric layer and including a feed portion and a loop portion outward extended from the feed portion; and the loop portion consisting of a plurality of turns of loops to define a plurality of mutually coupled radiation sections thereon, such that a multi-coupling effect between the radiation sections of the loop portion forms at least one variable frequency; and a second patterned conductive layer being provided on the dielectric layer and including a conductive portion and a short-circuit portion; and the conductive portion forming at least one fixed frequency;

wherein the at least one variable frequency of the loop portion can be adjusted in its frequency distribution and frequency range by changing a width of the radiation sections and a spacing distance between the radiation sections.

2. The full-band antenna as claimed in claim 1, wherein the loop portion is in a shape selected from the group consisting of a rectangular shape, a round shape, a triangular shape, and a polygonal shape.

3. The full-band antenna as claimed in claim 1, wherein the conductive portion includes a first radiation section parallel to and spaced from one side of the loop portion and a branch section extended from an end of the first radiation section to connect to the short-circuit portion.

4. The full-band antenna as claimed in claim 3, wherein the first radiation section includes a sidewardly protruded section located corresponding to the loop portion, so that a coupling effect is created between the protruded section and the loop portion.

5. The full-band antenna as claimed in claim 3, wherein the branch section includes a sidewardly protruded adjustment section for finely adjusting the at least one fixed frequency.

6. The full-band antenna as claimed in claim 1, wherein the conductive portion further includes a second radiation section connected to the feed portion.

7. The full-band antenna as claimed in claim 6, wherein the second radiation section further includes an extended section.

8. The full-band antenna as claimed in claim 1, wherein the conductive portion includes a first radiation section, a second radiation section parallel to the first radiation section, and a branch section; the first and the second radiation section both having an end connected to the branch section, the second radiation section being connected at an opposite end to the feed portion, and an end of the branch section opposite to the first and second radiation sections being connected to the short-circuit portion.

9. The full-band antenna as claimed in claim 1, wherein the conductive portion includes a connection section for connecting to the loop portion, a first radiation section connected to an end of the connection section opposite to the loop portion, and a branch section extended from an end of the first radiation section opposite to the connection section for connecting to the short-circuit portion.

10. The full-band antenna as claimed in claim 9, wherein the branch section includes a sidewardly protruded adjustment section for finely adjusting the at least one fixed frequency.

11. The full-band antenna as claimed in claim 9, wherein the feed portion includes two electrical connection sections extended through the dielectric layer to electrically connect a front surface to a rear surface of the dielectric layer; the two electrical connection sections respectively having a first end located on the front surface of the dielectric layer and an opposite second end located on the rear surface of the dielectric layer; the first ends of the two electrical connection sections being connected to the loop portion and a signal feed line, respectively, and the second ends of the two electrical connection sections being connected to each other via a conductive trace section.

* * * * *